US008264732B2

(12) United States Patent
Anderson et al.

(10) Patent No.: US 8,264,732 B2
(45) Date of Patent: Sep. 11, 2012

(54) CONTINUOUSLY PRINTING IMAGES ON A WEB MATERIAL AND CONTINUOUSLY TRANSFERRING THE IMAGES TO IDENTITY DOCUMENTS

(75) Inventors: David L. Anderson, Chanhassen, MN (US); James M. Jordan, Eagan, MN (US)

(73) Assignee: DataCard Corporation, Minnetonka, MN (US)

( * ) Notice: Subject to any disclaimer, the term of this patent is extended or adjusted under 35 U.S.C. 154(b) by 1421 days.

(21) Appl. No.: 11/679,611

(22) Filed: Feb. 27, 2007

(65) Prior Publication Data

US 2007/0199467 A1 Aug. 30, 2007

Related U.S. Application Data

(60) Provisional application No. 60/777,342, filed on Feb. 28, 2006.

(51) Int. Cl.
*B41L 3/02* (2006.01)

(52) U.S. Cl. ..... 358/1.18; 271/265.01; 399/67; 399/384; 399/401; 399/388

(58) Field of Classification Search ..... None
See application file for complete search history.

(56) References Cited

U.S. PATENT DOCUMENTS

| | | | | |
|---|---|---|---|---|
| 4,000,691 | A | 1/1977 | Fischer | |
| 4,162,847 | A * | 7/1979 | Brandon | 399/67 |
| 4,825,054 | A | 4/1989 | Rust et al. | |
| 4,972,314 | A * | 11/1990 | Getzinger et al. | 711/149 |
| 5,193,456 | A | 3/1993 | Wolfe et al. | |
| 5,266,781 | A | 11/1993 | Warwick et al. | |
| 5,420,852 | A * | 5/1995 | Anderson et al. | 370/364 |
| 5,974,297 | A * | 10/1999 | Creutzmann et al. | 399/384 |
| 6,095,701 | A | 8/2000 | Sattler | |
| 6,105,493 | A | 8/2000 | Skubic et al. | |
| 6,262,755 | B1 | 7/2001 | Skubic et al. | |
| 6,263,796 | B1 | 7/2001 | Jordan | |
| 6,902,107 | B2 | 6/2005 | Shay et al. | |

(Continued)

FOREIGN PATENT DOCUMENTS

DE 195 43 099 A1 5/1997

(Continued)

OTHER PUBLICATIONS

Office Action issued Dec. 18, 2009 by the State Intellectual Property Office of China in related application No. CN 200780010172.5 (with English translation).

(Continued)

*Primary Examiner* — Twyler Haskins
*Assistant Examiner* — Pawandeep Dhingra
(74) *Attorney, Agent, or Firm* — Hamre, Schumann, Mueller & Larson, P.C.

(57) ABSTRACT

A system and method for continuously printing images on a web material and continuously transferring the images to identity documents. A print component prints images on the web material. A registration component registers select images to identity documents. An applicator component applies the select images to the identity documents. A controller maintains throughput of the web material through the print component, registration component, and applicator component. The controller allows the system to continuously print images on the web material and continuously transfer the images to identity documents, in that it synchronizes cycles of the components, so that the components have simultaneous processing cycles and have simultaneous intervals between processing cycles.

18 Claims, 16 Drawing Sheets

U.S. PATENT DOCUMENTS

| | | | | |
|---|---|---|---|---|
| 2002/0194084 | A1* | 12/2002 | Surles | 705/26 |
| 2003/0129008 | A1* | 7/2003 | Seto | 399/388 |
| 2007/0007720 | A1* | 1/2007 | Shay et al. | 271/265.01 |

FOREIGN PATENT DOCUMENTS

| | | | |
|---|---|---|---|
| EP | 0 900 654 | A1 | 3/1999 |
| EP | 1047558 | | 4/2002 |
| EP | 1108551 | | 8/2004 |
| WO | 99/32291 | | 7/1999 |

OTHER PUBLICATIONS

PCT Written Opinion of the International Searching Authority for corresponding International Application No. PCT/US2007/062886.

PCT International Search Report for corresponding International Application No. PCT/US2007/062886.

Supplementary European Search Report issued by the European Patent Office, completed Sep. 1, 2009 in related application No. EP 07 75 7557.

* cited by examiner

CONTINUOUSLY PRINTING IMAGES ON A WEB MATERIAL AND CONTINUOUSLY TRANSFERRING THE IMAGES TO IDENTITY DOCUMENTS

The present application draws priority from U.S. Provisional Patent Application Ser. No. 60/777,342, entitled "Personalizing Identity Documents By Continuously Printing Images On A Web Material And Transferring The Images To The Identity Documents," and which is incorporated herewith by reference in its entirety.

FIELD

The technical disclosure herein relates to printing images and transferring the images to identity documents in the production thereof. Such identity documents can include for instance plastic cards, which may include financial (e.g. credit and debit) cards, drivers' licenses, national identification cards, or other related identity documents, such as passports, which usually bear personalized data unique to the card holder and/or which bear other card or document information. Particularly, the technical disclosure herein relates to printing images and transferring the images to identity documents on a continuous basis.

BACKGROUND

Document personalization systems and methods used in producing personalized documents and other personalized identity documents have been employed by institutions that issue such documents. Identity documents, which are often personalized by such systems and methods, may include plastic and composite cards, for instance financial (e.g. credit and debit) cards, drivers' licenses, national identification cards, and other related cards and documents which are personalized with information unique to the intended document holder.

Document personalization systems and methods can be designed for small scale, individual document personalization and production. In such small systems, a single document to be personalized is input into a personalization machine, which typically includes one or two personalization/production capabilities, such as printing and film application through heat transfer.

For large volume batch production of identity documents, institutions often utilize systems that employ multiple processing stations or modules to process multiple documents at the same time to reduce the overall per document processing time. Examples of such systems are disclosed by DataCard Corporation of Minneapolis, Minn., in U.S. Pat. Nos. 4,825,054, 5,266,781 and its progeny, and 6,902,107. Common to each of these types of systems is an input with the ability to hold a relatively large number of identity documents that are to be personalized/produced, a plurality of personalization/production stations through which each identity document is directed to undergo a personalization/production operation, and an output that holds the personalized identity documents. A controller is typically employed to transfer data information and instructions for operating the input, the personalization/production stations, and the output. As with small scale document personalization machines, batch production systems also include, for example, capabilities for heat transfer printing of images and heat transfer application of the images to an identity document.

Improvements may be made upon existing personalization/production stations, namely heat transfer printing and application modules. Particularly, improvements may be made on such modules that can provide increased throughput and efficiency. The technical disclosure described below can provide for a system of personalizing identity documents by printing images and applying them to the identity documents, where module timing and positioning may be improved, and while minimizing image and web material waste and document rejection.

SUMMARY OF THE DISCLOSURE

Generally, the present disclosure provides for continuous printing and application of images to identity documents. The technical disclosure herein is relevant to, among other applications, modular processing of personalized documents, where high speed document processing and throughput are desired. The disclosure is further relevant to such applications where document processing and throughput may be desired at a rate of, for example, about 500 identity documents processed/hour or higher.

More particularly, the present disclosure provides a system for and a method of printing and applying images to identity documents where printing, registration and applicator components have simultaneous processing cycles and have simultaneous intervals between processing cycles, such that continuous printing and application of images onto identity documents can occur.

The present disclosure may achieve efficient production of identity documents by improving system timing and mechanism positioning, while resulting in fewer rejected documents.

In one embodiment, a system for printing images and transferring the images to identity documents includes a web material having a surface that is printable thereon. A print component prints images on the web material. A registration component registers a select image to an identity document. An applicator component applies a selected image to the identity document, after the selected image has been registered with the respective identity document. A controller maintains continuous throughput of the web material through the print component, registration component, and applicator component. The controller synchronizes cycles of the components, such that they are configured to have simultaneous processing cycles and have simultaneous intervals between processing cycles.

In another embodiment, the print component prints a plurality of images on the web material. The registration component registers select images to a plurality of identity documents. The applicator component applies each selected image to one of the identity documents, when the selected image is registered with the respective identity document. The controller maintains continuous throughput of the web material through the components, where the controller synchronizes cycles of the components, such that they have simultaneous processing cycles and simultaneous intervals between processing cycles.

In another embodiment, a method for continuously printing images on a web material and transferring the images on the web material to identity documents includes printing a plurality of images on the web material. A select image from the web material is registered to an identity document. The image can then be applied to the identity document that the image is registered with. The steps of printing images, registering select images, and applying the select images are repeated a number of times in a continuous manner, whereby the steps of printing, registration, and application have synchronized cycles, such that the steps have simultaneous processing cycles and have simultaneous intervals between processing cycles.

In yet another embodiment, a system for printing and applying images to identity documents includes an assembly for maintaining tension in a web material. The assembly includes a support body with a displacement arm mounted on the support body. The displacement arm is receivable for supporting a web material at an initial tension on the displacement arm. The displacement arm is movable in a first direction when an increased tension is applied from one side, and is movable in a second direction when a decreased tension is applied from another side.

A detector component is mounted on the support body, and is operatively connected with the displacement arm. The detector component can detect a transition through movement of the displacement arm and indicated by increased or decreased tension on the displacement arm. The transition detected by the detector component is readable for making tension and velocity adjustments on the web material, so as to maintain uniform tension and constant velocity.

These and other various advantages and features of novelty, which characterize the inventive concepts, are pointed out in the following detailed description. For better understanding of the technical disclosure, its advantages, and the objects obtained by its use, reference should also be made to the drawings which form a further part hereof, and to the accompanying descriptive matter, in which specific examples illustrate and describe the principles of the inventive concepts.

BRIEF DESCRIPTION OF THE DRAWINGS

Referring now to the drawings in which like reference numbers represent corresponding parts throughout.

DETAILED DESCRIPTION

Figure 1:
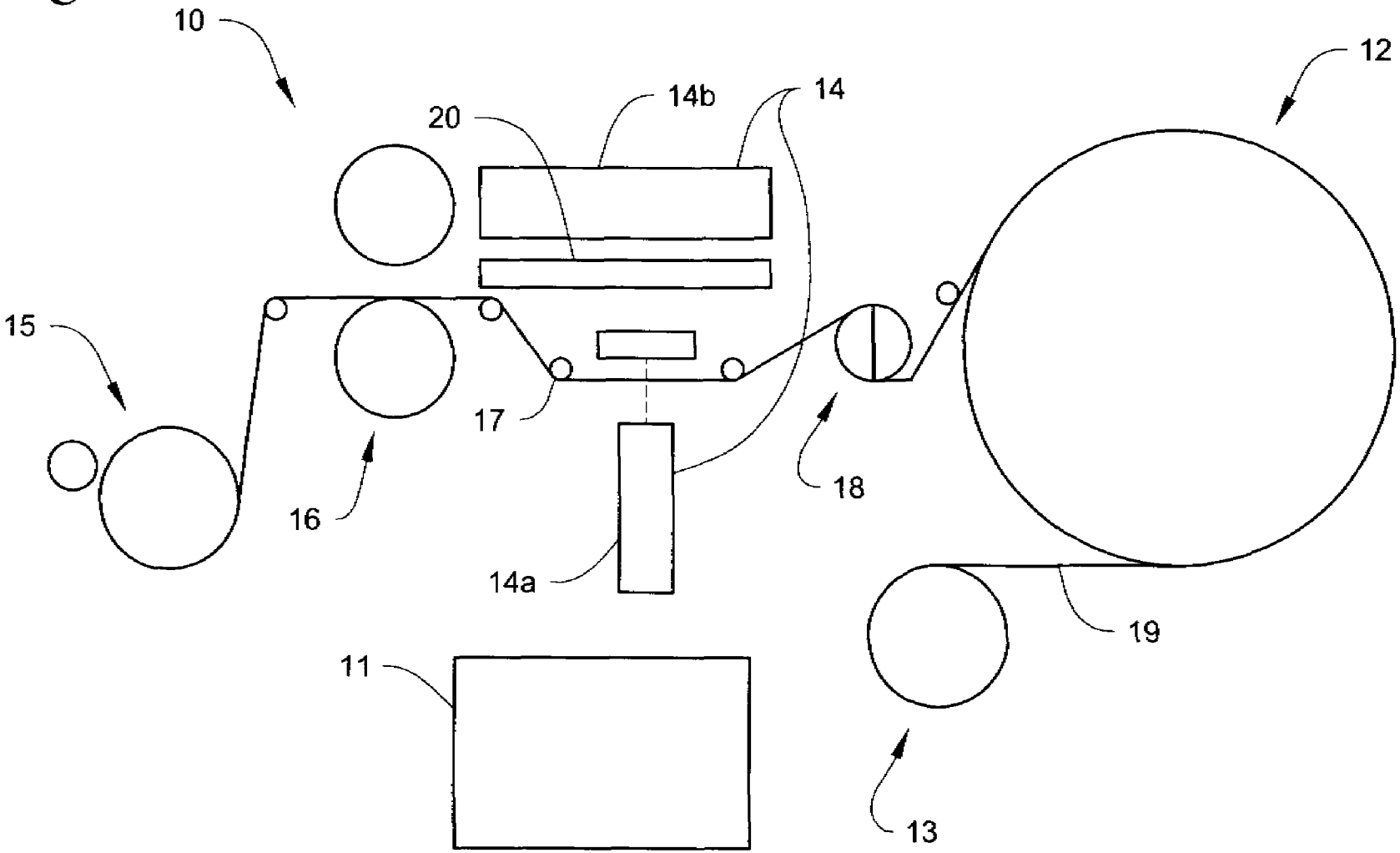
FIG. 1 represents a schematic view of one embodiment of a system for printing images on a web material and transferring images to identity documents.

FIG. 1 represents one exemplary embodiment of a system 10 for continuously printing images and transferring the images to, for example, identity documents in the production of personalized identity documents. Generally, the system 10 includes a print component 12, a registration component 14, and an applicator component 16. The print, registration, and applicator components cooperate to continuously print images and transfer images to identity documents, by having simultaneous processing cycles and simultaneous intervals between processing cycles.

The print component 12 prints images on a web material 19. Typically, the web material 19 is provided with a surface for printing thereon. The web material 19 is delivered to the print component 12 from a supply component 13. It will be appreciated that the supply component 13 may be a supply roll and spindle assembly as known in the art or any other suitable structure for supplying a run of the web material 19 to the print component 12. The print component 12 prints images on the web material 19. Once images have been printed on the web material 19, the web material 19 and the images printed thereon are delivered to a registration component 14.

The registration component 14 registers select images on the web material to documents, such as identity document 20. The registration component 14 assures that each selected image is correctly registered with a respective identity document before the image is applied to its identity document 20 with the applicator component 16. That is, the identity document 20 and the selected image on the web material 19 are paired and positioned, so that they simultaneously enter the applicator component 16 for the select image to be applied to the identity document.

The applicator component 16 applies each selected image from the web material 19 to its respective identity document 20. The applicator component 16 applies the image to the identity document once the image is registered with its respective document. As select images are applied to identity documents, the remaining web material 19 (without the images) is collected by a take-up component 15. It will be appreciated that the take-up component 15 may be a take-up roll and spindle assembly as known in the art or any other suitable structure that can take-up used web material after application.

Transport members 17 facilitate throughput of the web material 19 through the system and the components 12, 14, and 16. It will be appreciated that the transport members 17 may be transport rollers as known in the art or any other suitable structure for facilitating delivery of the web material 19 through the system 10.

As shown in FIG. 1, one identity document 20 is shown being processed through the system 10. It will be appreciated that continuous processing can occur, such that a plurality of images may be continuously printed on the web material 19 and a plurality of selected images may be continuously applied to a plurality of respective identity documents. As another example, a transport or conveyor as known in the art (not shown) can deliver a plurality of documents successively (such as a plurality of identity documents 20) to the registration component 14.

A controller 11 is operatively connected with the print component 12, registration component 14, and applicator component 16 for transferring data information and instructions for operating the components. The controller 11 maintains continuous throughput of the web material 19 through the system 10 to continuously print images and apply select printed images from the web material to identity documents. The controller 11 synchronizes operation cycles of the components 12, 14, and 16, such that the components have simultaneous processing cycles and have simultaneous intervals between processing cycles. As one example, the controller 11 may be a CPU that controls the print, registration, and applicator components through suitably constructed firmware configurations, or in other examples, as suitable computer programs contained permanently in a hardware device as read-only memory.

In operation, the controller includes control firmware that can enable the system 10 to simultaneously perform the functions of printing, registration, and application, so as to provide continuous (non-stop) document processing. For example, a document immediately preceding the document in the applicator component 16 can be retrieved, such as by a document conveyor (not shown), and positioned by the registration component 14 with a select image from the web material, while the print component 12 prints images on the web material 19. It will be appreciated that a document conveyor may be any structure or mechanism known in the art and that is suitable for carrying and/or transporting the identity documents to the registration component. Likewise, a document may be simultaneously processed in a module immediately upstream or downstream of the system 10.

During registration, the registration component 14 includes a mechanism 14*b* that registers and feeds identity documents into the applicator component 16. The registration component 14 also includes a mechanism 14*a* that examines the web material 19 by looking for a registration mark of the next select image. On detection of the web registration mark, the respective identity document and image are registered, such that they are paired and positioned to be simultaneously fed into the applicator component 16, where the image can be applied to the identity document. It will be appreciated that some images may not be selected by the registration component, and are for example "passed over," where such images run through the registration and applicator components to the take-up without being applied to an identity document.

In another embodiment, the system includes a tension adjustment mechanism 18. The tension adjustment mechanism 18 is configured to maintain constant velocity and uniform tension of the web material within and between components of the system 10. An example of a tension adjustment mechanism is further discussed in FIGS. 15-17 below.

In yet another embodiment, the system 10 includes component spacing in such a manner that if an error occurs, for example, the current identity document in the applicator component 16 is not rejected and the existing images on the web material 19 can be saved. On detection of an error in the system, such as upstream of the printer component 12, between any of the print component 12, registration component 14, and applicator component, or downstream of the applicator component 16, the next image application cycle will not be initiated. The web 19, and components 12, 14, 16 are stopped. The web material 19 may then be reversed to a recovery (restart) position. The components of the system 10 remain idle or in a non-active interval between processing cycles, until the reported error condition has been repaired. When the error condition has been repaired, the printing, registration, and application cycles can be resumed to simultaneous and continuous processing.

System and Method for Continuous Apply

FIGS. 2 through 6 illustrate another embodiment of a system 100 for continuously printing images on a web material and transferring the images to documents, such as in personalizing identity documents.

It will be appreciated that the term identity documents is to be broadly construed, and that the following descriptions of cards is exemplary only and employed for purposes of representing one embodiment of the disclosure. It will be further appreciated that such identity documents can include for instance plastic cards, which may include financial (e.g. credit and debit) cards, drivers' licenses, national identification cards, or other related identity documents constructed of various mediums other than cards, such as passports or other identity documents that usually bear personalized data unique to the card holder and/or which bear other document information.

The system 100 is similar to the system 10 and including such differences as described herein. The system 100 includes a print component 120, a registration component 140, and an applicator component 160.

The system 100 is supported by a frame structure 112. It will be appreciated that any suitable frame structure may be employed and that the system is not limited to the specific structure shown in the figures, so long as the components of the system are provided with proper support to carry out their functions.

The print component 120 prints images on a web material 190. The web material 190 may be delivered to the print component 120 from a supply roll and spindle assembly 130. A guide pin 120*c* is employed to help support the web material 190 and route it to the print component. The web material 190 is provided with a surface, such that images 192 and registration marks 192*a* disposed at trailing edges of the images 192 are printed on the web material 190 (best shown in FIGS. 8 through 10). The images 192 and registration marks 192*a* will be further described below.

It will be appreciated that the web material 190 may be a continuous print media. In one example, the web material 190 is a pigment receptive carrier onto which the images and registration marks are printed. In another example, a final print station of the print component 120 can be designated to also apply a thermally activated resin layer to the web material 190 to be subsequently applied to a card. The resultant image can be a thin layer thermally transferable from the web material 190 onto the card. As one example, the thin layer may have a thickness of about 0.5 microns. It will be appreciated that the thin layer may vary as necessary or suitable. It further will be appreciated that the web material 190 is constructed so as to allow the image 192 and resin layer (if present) to be released from the web material 190 and be applied onto the card, such as when the image is thermally activated by the applicator 160. That is, the "image material" may be made up of each color pigment printed by the print component and a thermally activated resin layer (or adhesive layer) acting as a primer. The image material is transferred from the web to the identity document, such as by using heat and pressure.

In one exemplary embodiment only, the web material 190 may be configured such that the gap 194 between printed images may be approximately 0.2 inches. A distance from a trailing edge of one image 192 at its registration mark 192*a* through a gap 194 to the trailing edge (or registration mark) of another image is approximately 3.8 inches. In such an exemplary configuration, the print component 120 may include print heads that are spaced about 3.8 inches dot row to dot row, where the cards on which the images are applied have approximately a 3.375 inch width. Thus, an image may be overprinted by about 2100 columns (at about 600 columns per inch) for a total distance of about 3.5 inches. The registration mark 192*a* for image registration and identification may be about 0.1 inches wide, so as to leave an inter image gap 194 of about 0.200 inches.

As with the spacing of the print heads, the system 100 can include component spacing in such a manner that if an error occurs, the current document or card in the applicator component 160 is not rejected and the existing images on the web material 190 can be saved. The registration component 140, particularly the web registration mechanism 140*a* discussed below, and the applicator component 160 can include a component spacing configuration downstream from the print component 120.

As one example only, the image to image spacing, which may be the 3.8 inches described above, may be used as a repeat length to determine how far downstream the web registration mechanism 140*a* and applicator component 160 are spaced from each other and spaced from the print component 120. In one example, the web registration mechanism 140*a* may be positioned a multiple of this repeat length, such as at three times the repeat length from the last print head of the print component 120. The applicator component 160 also may be spaced downstream from the web registration mechanism at a multiple of the repeat length, such as at one repeat length from the web registration component 140*a*.

It will be appreciated that the repeat length may vary as necessary for providing suitable component spacing of the system. It will further be appreciated that the repeat length may be predetermined and may vary according to sizing requirements of the overall system 100 and the type identity document being processed or personalized. Likewise, it will be appreciated that the component spacing is not limited to certain multiples of any repeat length employed. It will be further appreciated that components, other than the print, registration, and applicator components, employed in the system 100 can be positioned according to a multiple of a repeat length determined.

Figure 4:
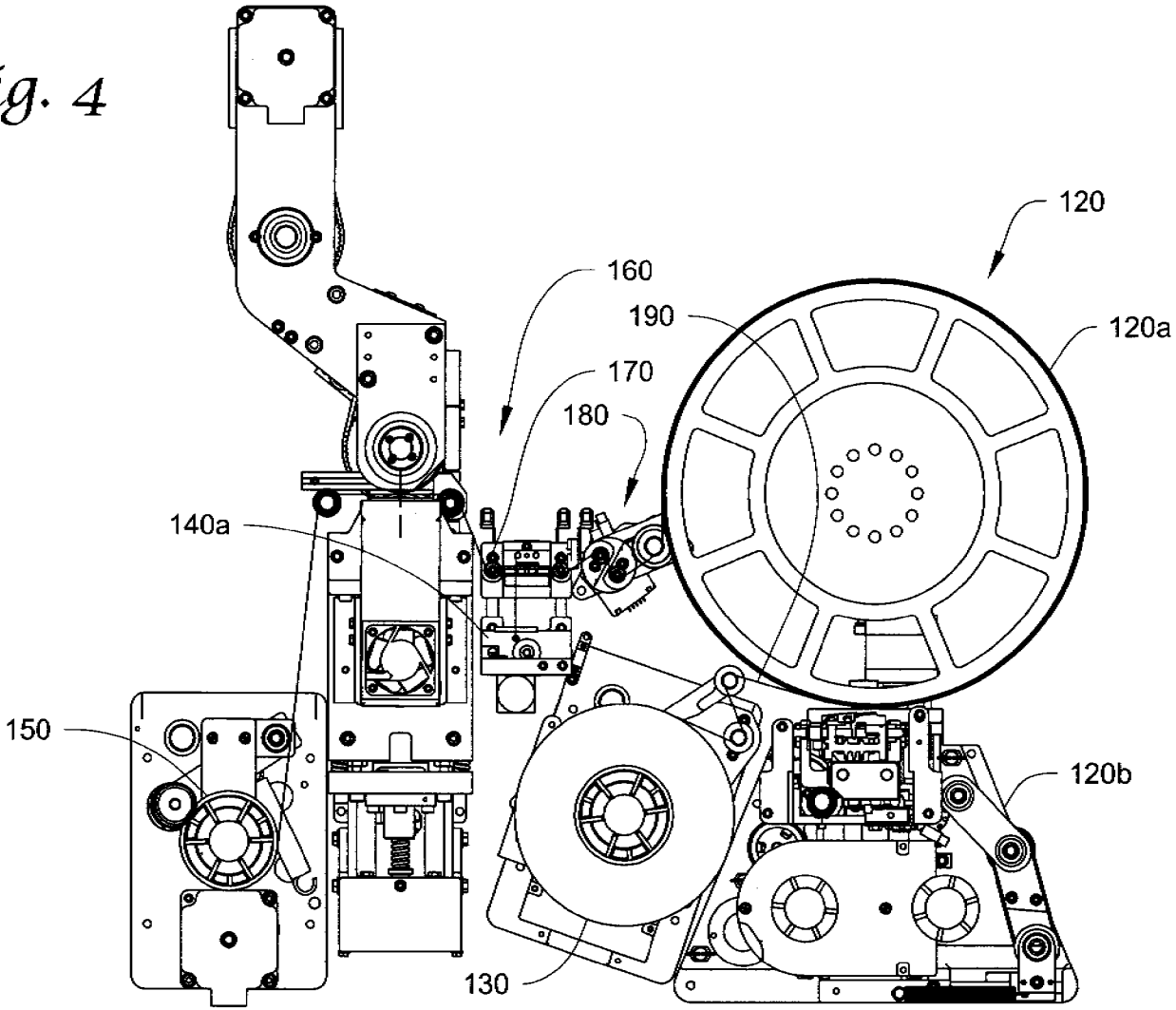
FIG. 4 represents a partial top plan view of the system of FIG. 2.
Figure 5:
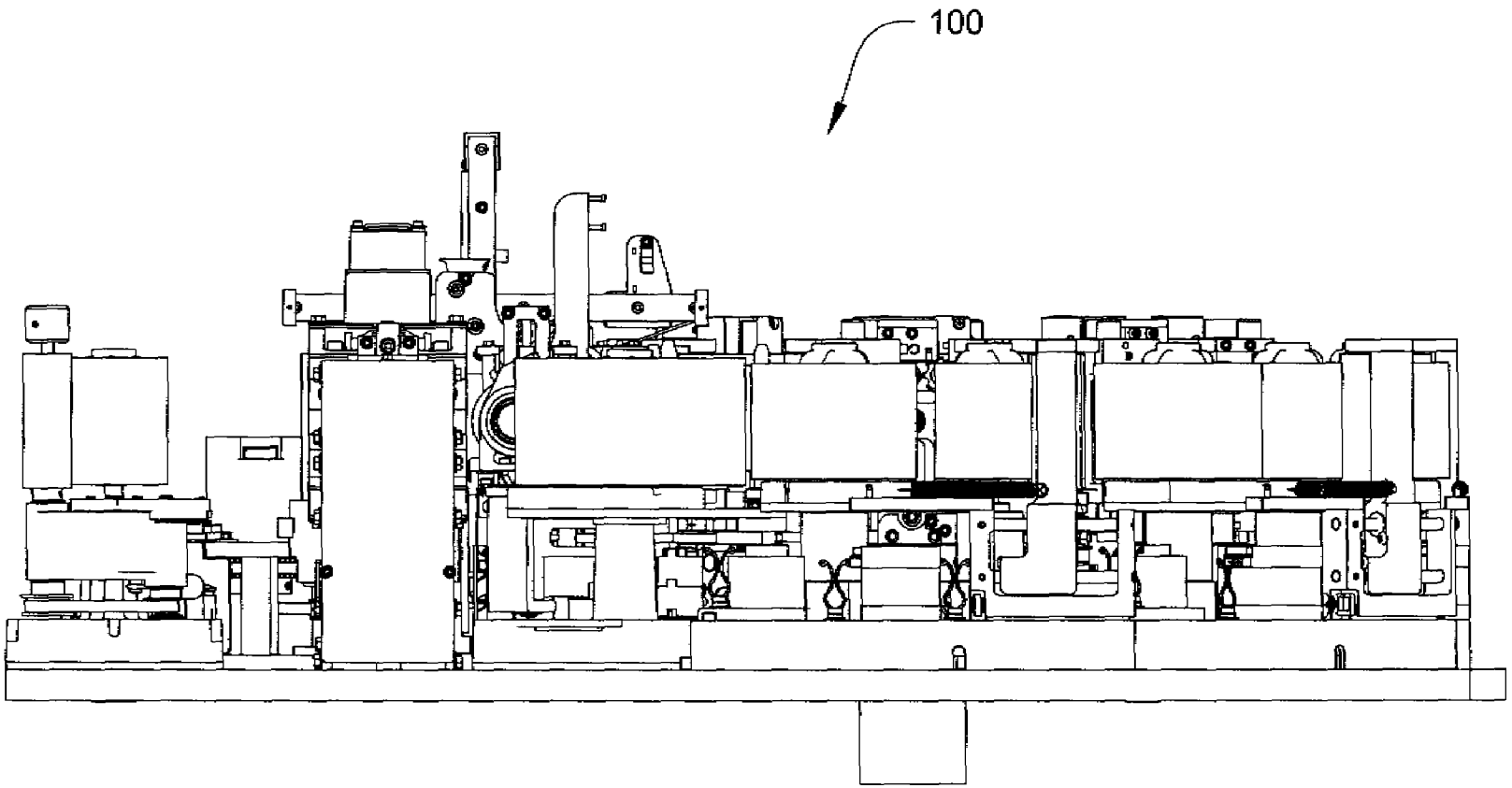
FIG. 5 represents a side view of the system of FIG. 2.
Figure 6:
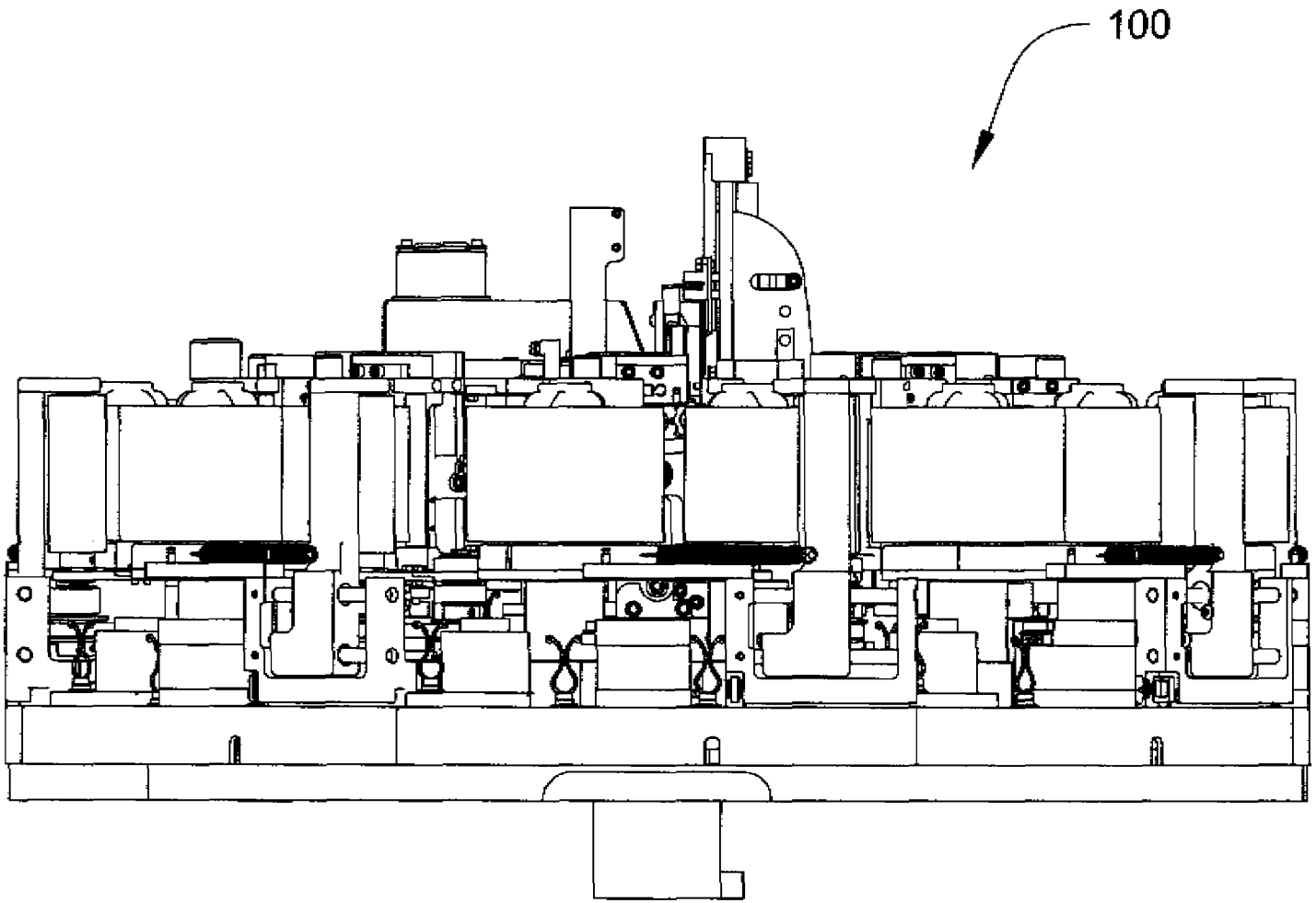
FIG. 6 represents another side view of the system of FIG. 2 and opposite the view of FIG. 5.
Figure 7:
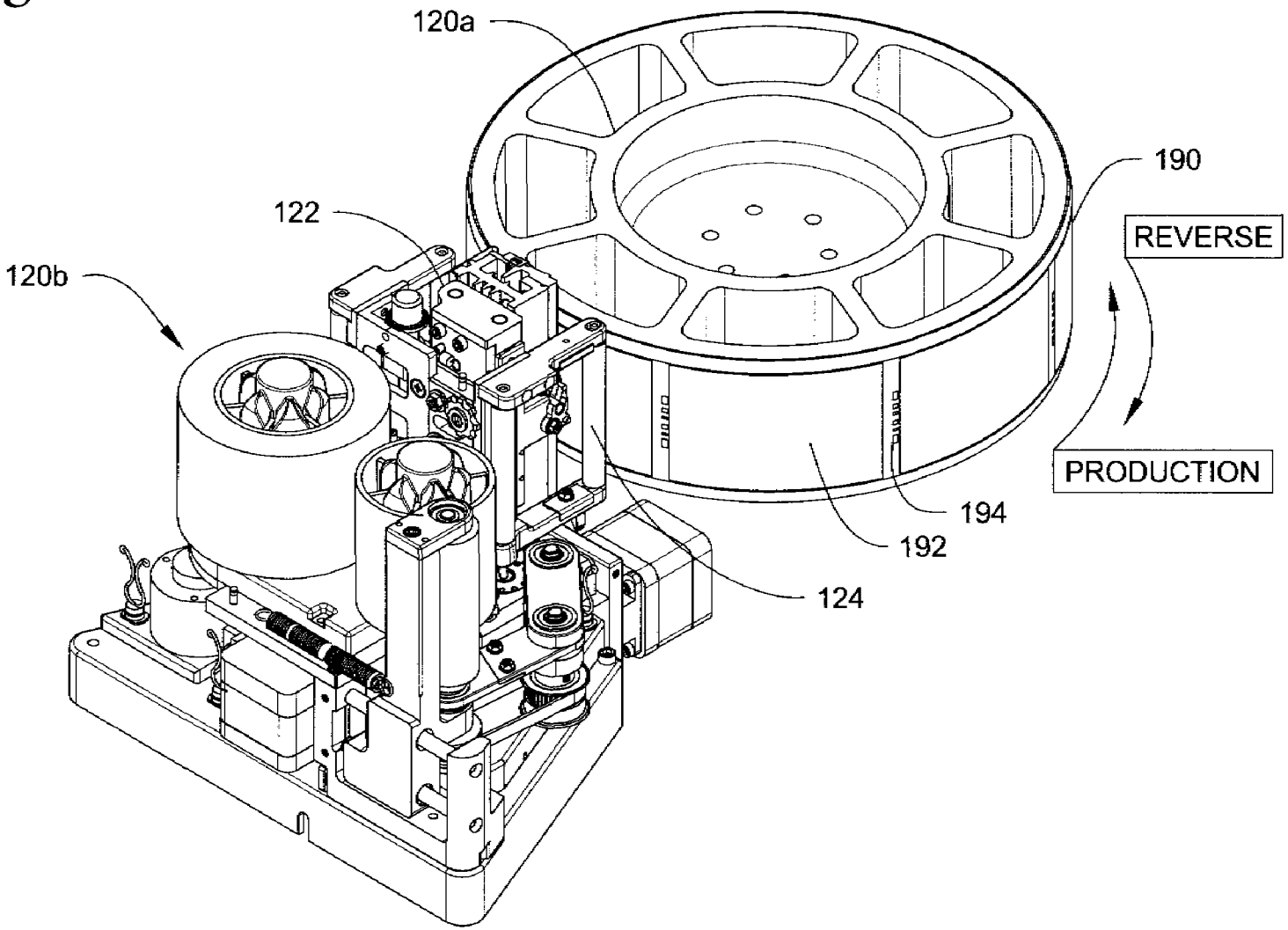
FIG. 7 represents a partial isometric view of one embodiment of a print component for the system shown in FIG. 2.

Turning to the print component 120, at least one thermal print head assembly 120*b* may be disposed about a print drum 120*a* (see FIG. 4). As one example, the print component 120 includes a plurality of thermal print heads 120*b* disposed about the print drum 120*a*, such as used in multicolor printing (see FIG. 2-3). In one embodiment, the print component 120 supports six thermal print heads 120*b* about the print drum 120*a*. The print component 120 prints at least one image 192 on the web material 190. As known, a print drum 120*a* can include an outer surface with a high friction gripping surface, such as a silicon coated rubber material. It will be appreciated that the print drum 120*a* may have any suitable coating or adhesive for providing the high friction gripping surface.

Multicolor printing employing a print drum and multiple thermal print heads is well known, such as in Applicants' issued U.S. Pat. No. 6,262,755, and is not further detailed. Once images 192 have been printed, the web material 190 is delivered to the registration component 140.

The registration component 140 registers select images 192 to be applied onto cards. The registration component 140 includes a web registration mechanism 140*a* for the web material 190 and a document registration mechanism 140*b* for the identity document or card. The registration component 140 assures that the select images 192 are correctly registered or paired and positioned with a respective card before the image 192 is applied onto the card. That is, the web registration mechanism 140*a* and the document registration mechanism 140*b* are configured to position selected images on the web material with respective cards such that each image and card simultaneously enter the applicator component 160.

An applicator component 160 applies the selected images 192 from the web material 190 to respective cards in succession. The applicator component 160 applies the image to the card once the image is registered with its respective card. As described, both the web material having the image and the respective card simultaneously enter the applicator component 16. In one embodiment, the applicator component 160 applies the select images 192 to cards through a thermal transfer process using heated rollers that is known in the art. As select images are applied to cards, the remaining web material 190 (without the select images) is collected by a take-up roll and spindle assembly 150. Transport rollers 170 facilitate throughput of the web material 190 through the system and the components 120, 140, and 160.

As with system 10, a controller (i.e. controller 11) is operatively connected with the print component 120, registration component 140, and applicator component 160 for transferring data information and instructions for operating the components. The controller can maintain continuous throughput of the web material 190 through the system 100. The controller allows the system to continuously print and apply images to the cards, by synchronizing operation cycles of the components 120, 140, and 160, where the components have simultaneous processing cycles and have simultaneous intervals between processing cycles. The controller may be a CPU that controls the print, registration and applicator components through suitably constructed firmware configurations.

In operation, the controller includes firmware that can enable the system 100 to simultaneously perform the functions of printing, registration, and application, so to provide continuous card processing. For example, a document immediately preceding the document in the applicator component 160 can be retrieved, such as by a document conveyor (not shown), and positioned by the card registration mechanism 140*b* with a select image from the web material 190, while the print component 120 prints images on the web material 190. It will be appreciated that a document conveyor may be any structure or mechanism known in the art and that is suitable for carrying the identity documents to the registration component. Likewise, a document may be simultaneously processed in a module immediately upstream or downstream of the system 10.

During registration, the card registration mechanism 140*b* registers and feeds cards into the applicator component 160. The web registration mechanism 140*a* examines the web material 190 by looking for the web registration mark 192*a* of the next select image 192. On detection of the web registration mark 192, the card and image 192 are registered and fed together into the applicator component 160, so the image 192 can be applied to the card.

On detection of a function error, such as in the printer component 120, the registration component 140, and/or the applicator component 160, the next application cycle is not initiated. The web 190 and the print component 120 including the print drum 120*a* are stopped, while the thermal print heads 120*b* are retracted. The currently active print cycle and currently active application cycle may complete before the print heads 120*b* are retracted and the drum 120*a* is stopped. On the applicator component 160, a heated roller retracts to its home position. The web material 190 may then be reversed to a recovery (restart) position. See descriptions of FIGS. 8 through 10 below. The components of the system 100 remain idle or in a non-active interval between processing cycles, such as during an error. When the reported error condition has been repaired, the printing, registration, and application cycles can be resumed to simultaneous processing.

The system 100 enables the cards and the images to be fed into the applicator component on a continuous basis, because the processing and inactive cycles of the print, registration, and applicator components are synchronized. Such a system can reduce the need to reverse the web material unless an error actually occurs. As a result, card processing throughput can be increased, while reducing the number of rejected images and cards due to modular or system errors.

Print Component

FIGS. 7 and 8 through 10 illustrate one embodiment of a print component 120, such as for the system 100 shown above in FIGS. 2 through 6. The print component 120 includes the print drum 120*a* with at least one thermal print head 120*b* disposed about an outer side of the print drum 120*a*.

Generally, the print drum 120*a* moves in the production direction during a card processing cycle, in which the print component 120 prints images 192 on the web material 190. (See FIG. 7.) When an error occurs, such as in the print component 120 or in the other components in the system 100, the printing process cycle stops at the end of an image panel strip pin 124. The drum may then reverse to a gap 194 between images on the web material 190. When the system 100 is recovered, the thermal print heads 120*b* can engage the print drum 120*a* starting in one of the gaps 194 between images and normal production can continue. In such a configuration, unfinished images in process may be saved.

The print component 120 may include a cleaning roller 122. (See e.g. FIGS. 3 and 7.) In one embodiment, the cleaning roller 122 may be disposed before each print head 120*b* so to contact the web material 190 and remove any debris that is present before printing occurs at each print head.

Figure 8:
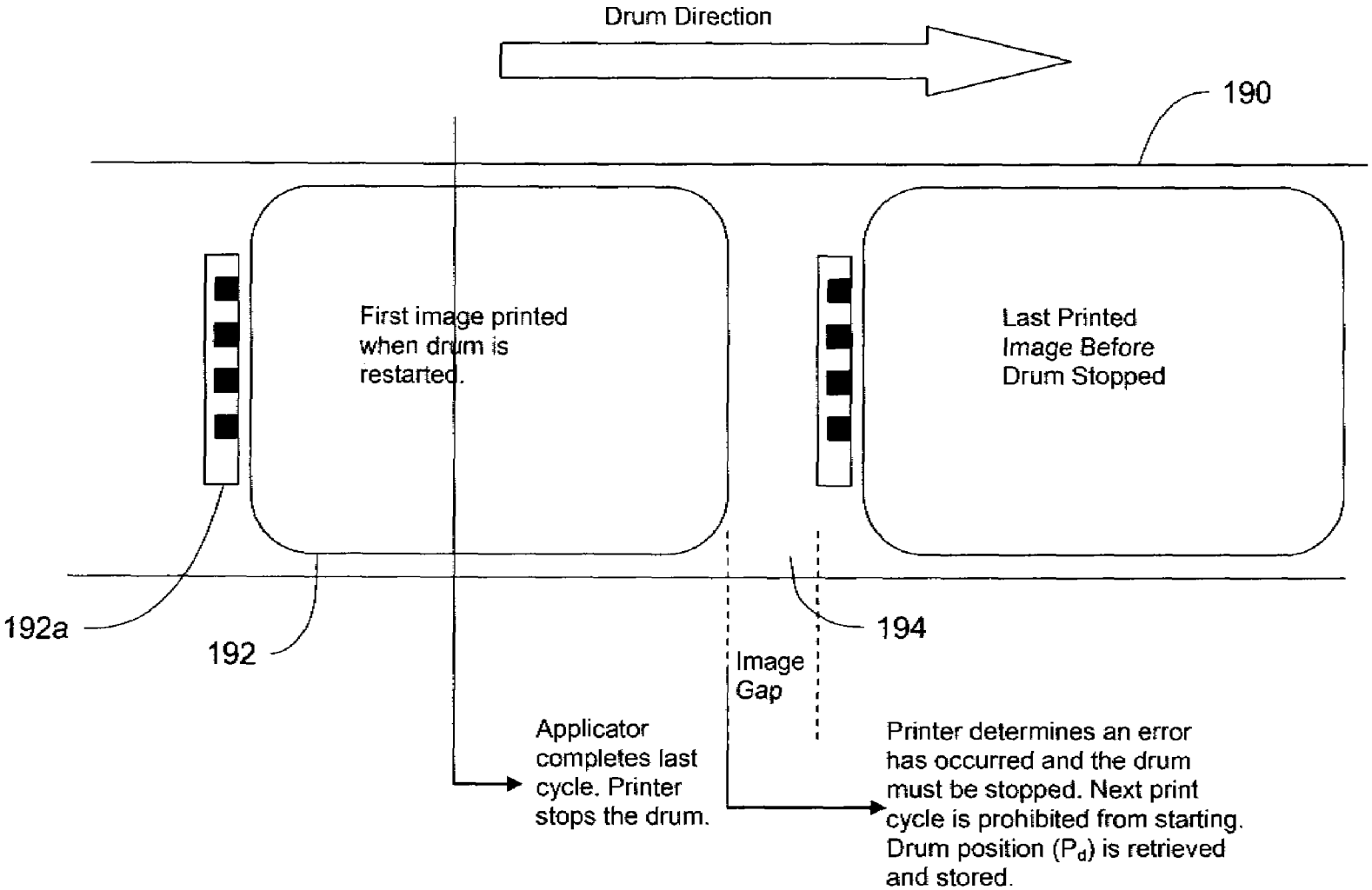
FIG. 8 represents a partial schematic view of a print component in operation, and shows the print component during a state where a printing cycle has stopped processing.
Figure 9:
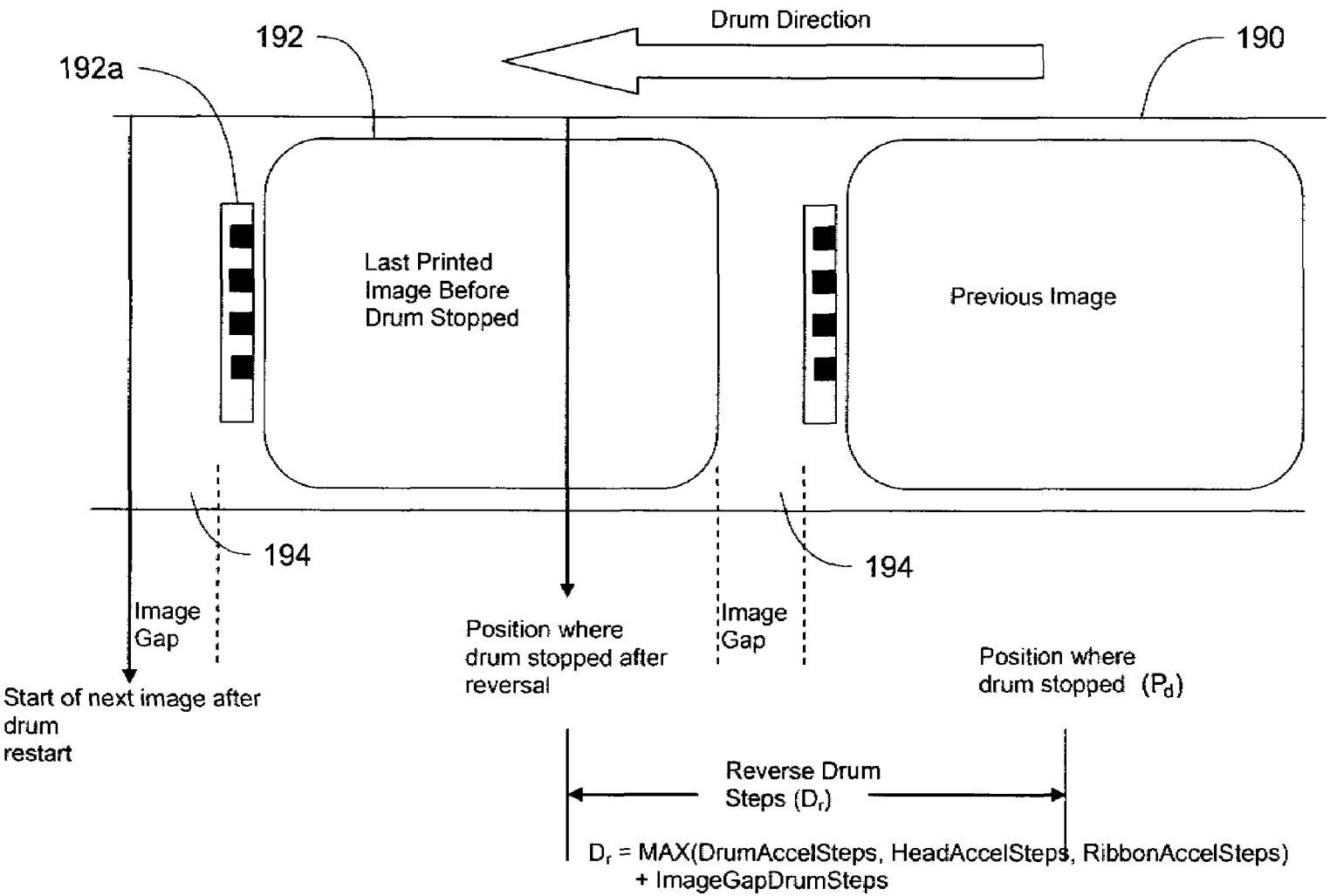
FIG. 9 represents a partial schematic view of the print component in operation, and shows the print component during a state where the printing cycle is being corrected.
Figure 10:
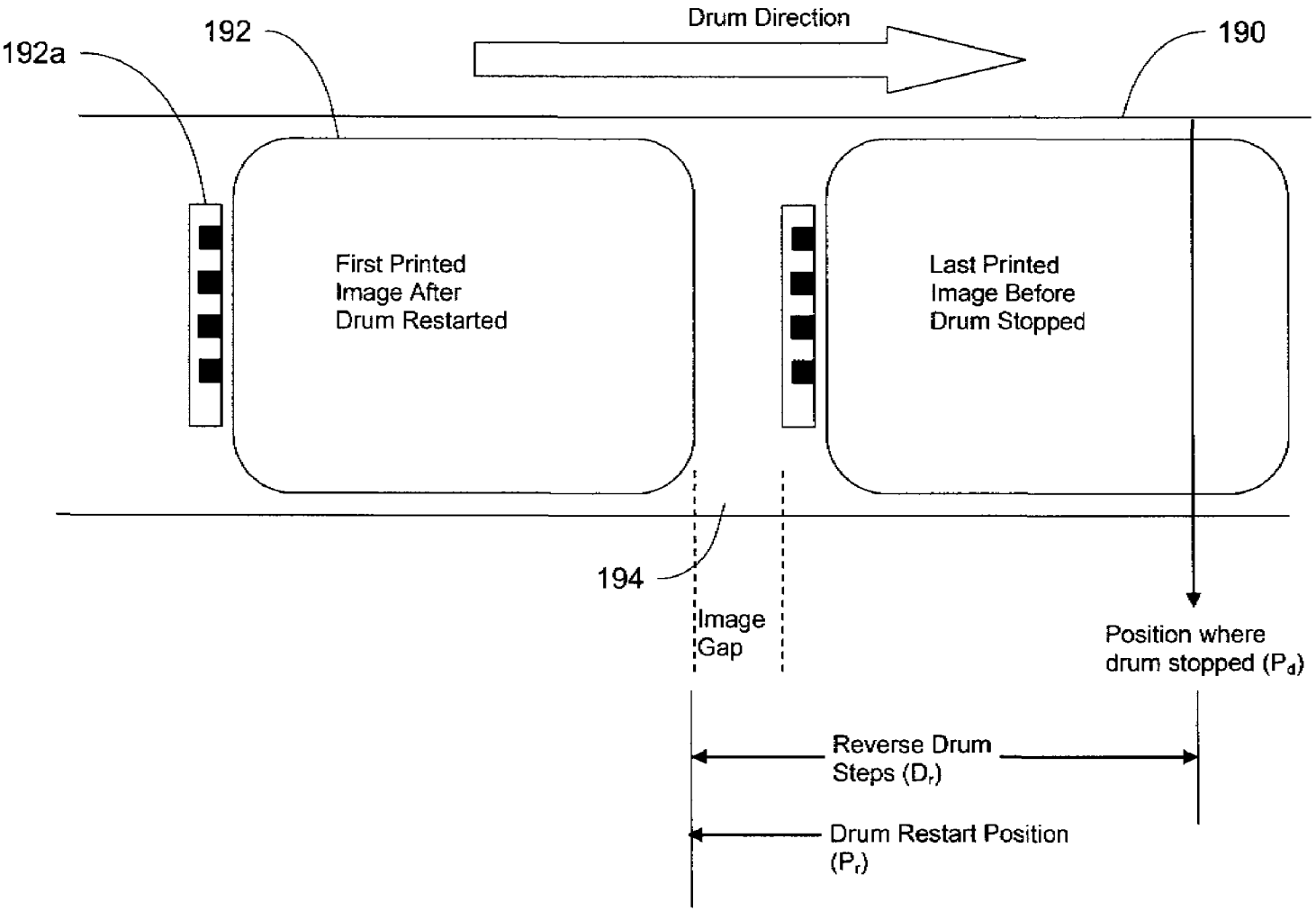
FIG. 10 represents a partial schematic view of the print component in operation, and shows the print component during a state where the printing cycle has resumed.
Figure 11:
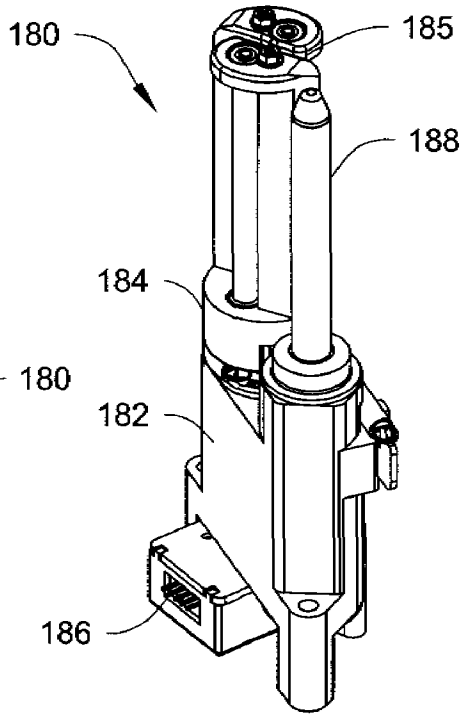
FIG. 11 represents an isometric view of one embodiment of a tensioning mechanism for the system shown in FIG. 2.
Figure 12:
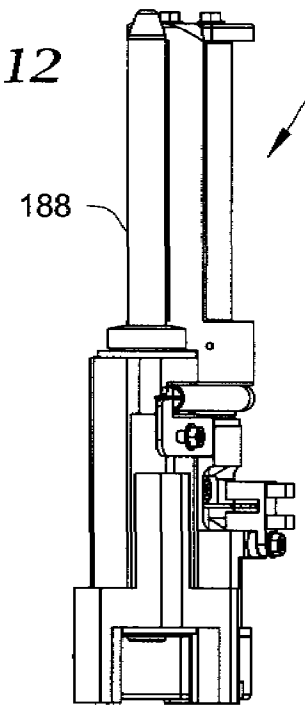
FIG. 12 represents a side view of the tensioning mechanism shown in FIG. 11.
Figure 13:
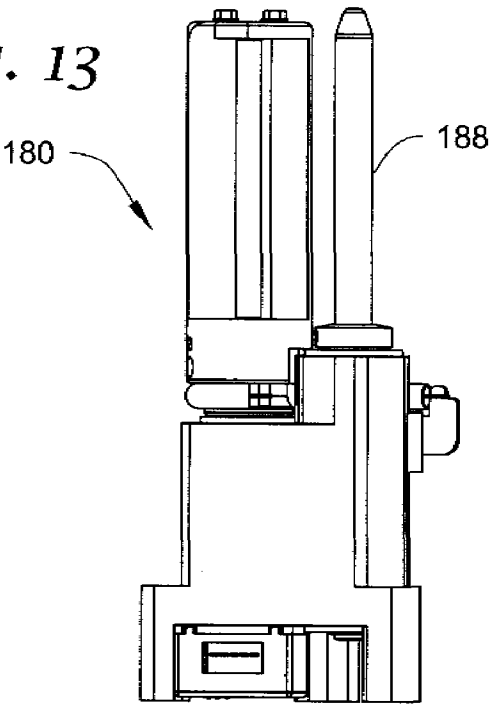
FIG. 13 represents another side view of the tensioning mechanism shown in FIG. 11.
Figure 14:
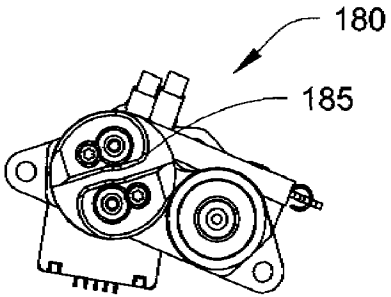
FIG. 14 represents a top view of the tensioning mechanism shown in FIG. 11.

FIGS. 8 through 10 depict partial schematic views of a print component in operation, such as print component 120, and show the print component during states where a printing cycle has stopped processing (FIG. 8), where the printing cycle is being corrected (FIG. 9), and where the printing cycle has resumed (FIG. 10). As described, a controller is operatively connected with the print component (i.e. controller 11). The controller maintains throughput of the web material 190 through the system so that continuous printing and applying of images can occur. The controller synchronizes operation cycles of the print, registration, and applicator components, such that the components have simultaneous processing cycles and have simultaneous intervals between processing cycles, such as when there is an error in the system. In one embodiment, the controller may be a CPU that controls the components through suitably constructed firmware configurations, of which the operation of the print component is described below.

The starting and stopping of the drum and web or retransfer material represent a key element in thermal printing, since this technology has overcome the thermal problems experienced by dye sublimation/thermal transfer technology. The print component 120 enables printing to be stopped and restarted, without thermal artifacts in the image (such as optical density shifts).

As one example for a multiple thermal print head print component, the print heads start a print cycle at the same time. For a print component having four print heads, a primer head begins printing the primer canvas of a first image, while a yellow head begins printing the yellow canvas of a second image. A magenta head begins printing the magenta canvas of a third image, and a cyan head begins printing the cyan canvas of a fourth image. It will be appreciated that the number of print heads is exemplary only. A print component may include additional or less print heads disposed about the print drum. As shown, the print component 120 includes six thermal print heads.

Prior to starting a print cycle, the controller determines if the print drum of the print component needs to be stopped due to a detected functional error, for example a print component error, an applicator component error and/or a card transport error (including a registration component error). On detection of an error in any areas of the system, the controller retrieves and stores a current rotational position ($P_d$) of the print drum of the print component, and determines if the applicator component 160 is currently in an active application cycle. (See FIG. 8.) If the applicator component 160 is active, the print component waits until the current application cycle has been completed. Once the applicator component is idle (between images), the print component 120 retracts the thermal print heads 120*b* from the drum, stops its print ribbons, and stops the print drum 120*a* (including a retransfer material (RTM) web take-up motor).

In FIG. 9, once the print component is stopped, it reverses the print drum and web material 190 past the stored drum position ($P_d$) a certain distance. The distance is determined by a number of motor steps necessary to restart the print component. A number of drum motor steps required to accelerate the drum motor (DrumAccelSteps or $D_a$) is included in this determination. Further, if the time required to position the print heads (HeadAccelSteps or $T_h$) and accelerate the print ribbons (RibbonAccelSteps or $T_r$) is greater than the time required to accelerate the drum motor to its required print speed, the difference in time is added to the number of drum motor steps required to accelerate the drum motor ($D_a$). The distance between images (ImageGapDrumSteps) is also included in the summation of steps to give a total steps ($D_r$) to restart the print component. As shown, the print drum is reversed past the stored drum position ($P_d$) a distance determined by the total number of steps ($D_r$), where the last printed image before the drum stopped is positioned before the position where the print drum stopped ($P_d$).

On detecting stopping of the print component 120, the registration and applicator components 140, 160 do not attempt to initiate their next processing cycles until the error has been reported and the condition rectified. For example, on detection of a stopped print drum 120*a*, the applicator component 160 returns the heated roller to its home position and waits for the print component 120 to restart.

As shown in FIG. 10, the summation or total steps ($D_r$) is used to restart the print component. The web material 190 is moved forward so that the leading edge of the first image printed after the print drum is restarted 192 is positioned at the drum restart position ($P_r$). In this configuration, the error has been reported and rectified and the print component may restart the print cycle by starting the print drum, starting the print ribbons, and dropping the thermal print heads.

FIGS. 8-10 show that the distance the print drum reverses is determined by the amount of forward travel that occurs between the completion of printing the final image before stopping and when the drum is physically stopped. This distance can vary due to the applicator component being in an active apply state at the time the print component is to be stopped. Given the variable distance, a configurable reverse distance can be determined that is greater than the time required to get all motors up to slew and the printing initiated. On restarting the print component, the print drum will advance this configurable distance before resuming the print operation. In this configuration, the print operation may continue at the point it would have had printing not been stopped.

On detection of the print drum restarting, the applicator component 160 can lower its heated rollers and begin the next application cycle. It will be appreciated that while the applicator component 160 is idle, temperature of its heated rollers can be maintained in order to minimize the restart time.

In the continuous print and apply system, errors may be experienced on any of the components of the system 100 at any given time. The system 100 can handle these error conditions with minimal material waste. In addition to print errors and application errors, there may be card handling errors, all of which can be asynchronous to one another. The starting and stopping of the print drum 120*a* and web material represent a key element in such thermal printing methodology. The print component 120 described can help overcome the thermal problems experienced by dye sublimation/thermal transfer technology, by stopping and restarting printing, so to prevent thermal artifacts in the image (such as optical density shifts).

With the print component described, rejection of images in process can be reduced, thereby resulting fewer rejected cards and cost savings to card producers and customers.

Web Tension Adjustment Mechanism

Figure 2:
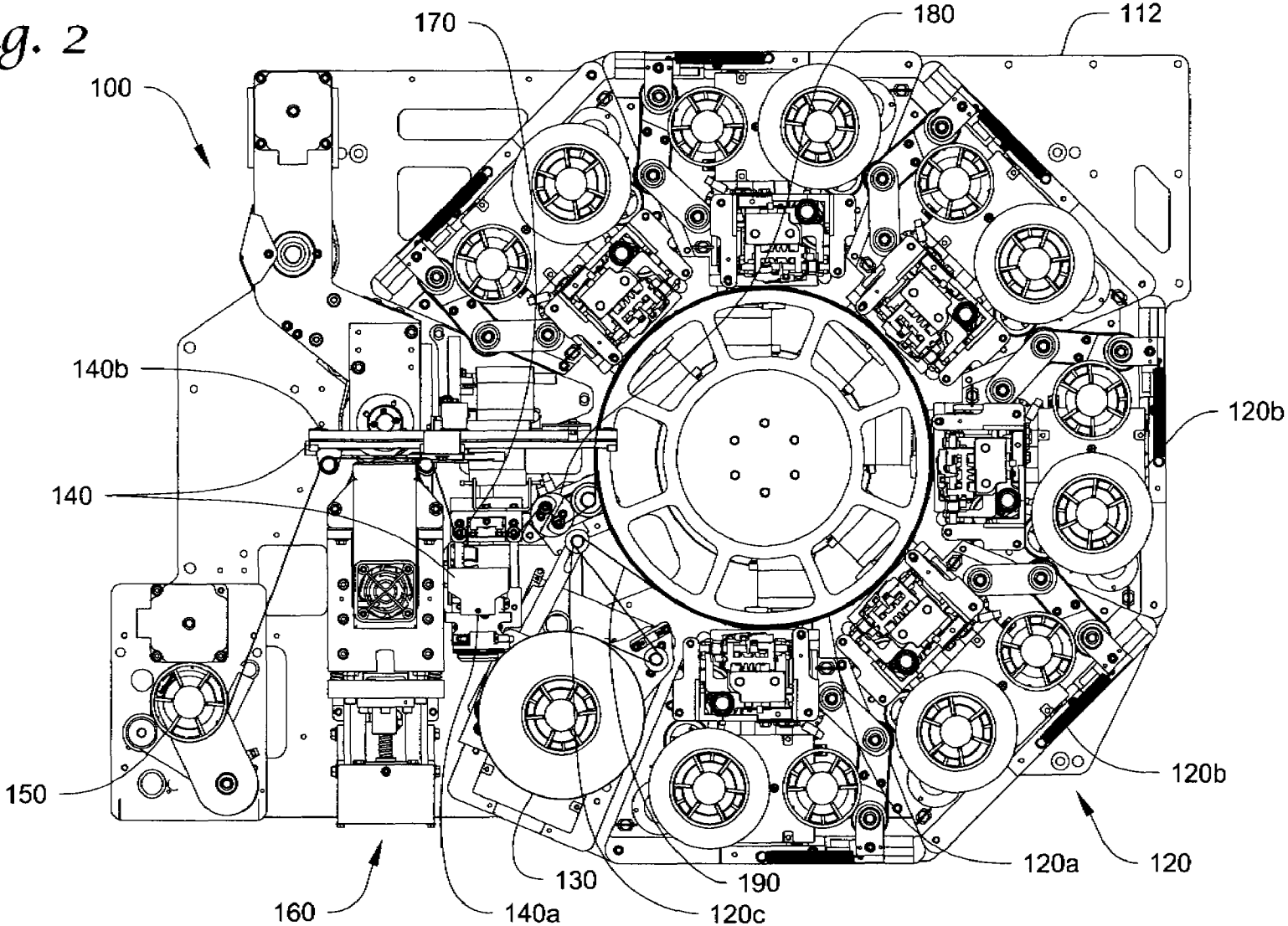
FIG. 2 represents a top plan view of another embodiment of a system for printing images on a web material and transferring images to identity documents.
Figure 3:
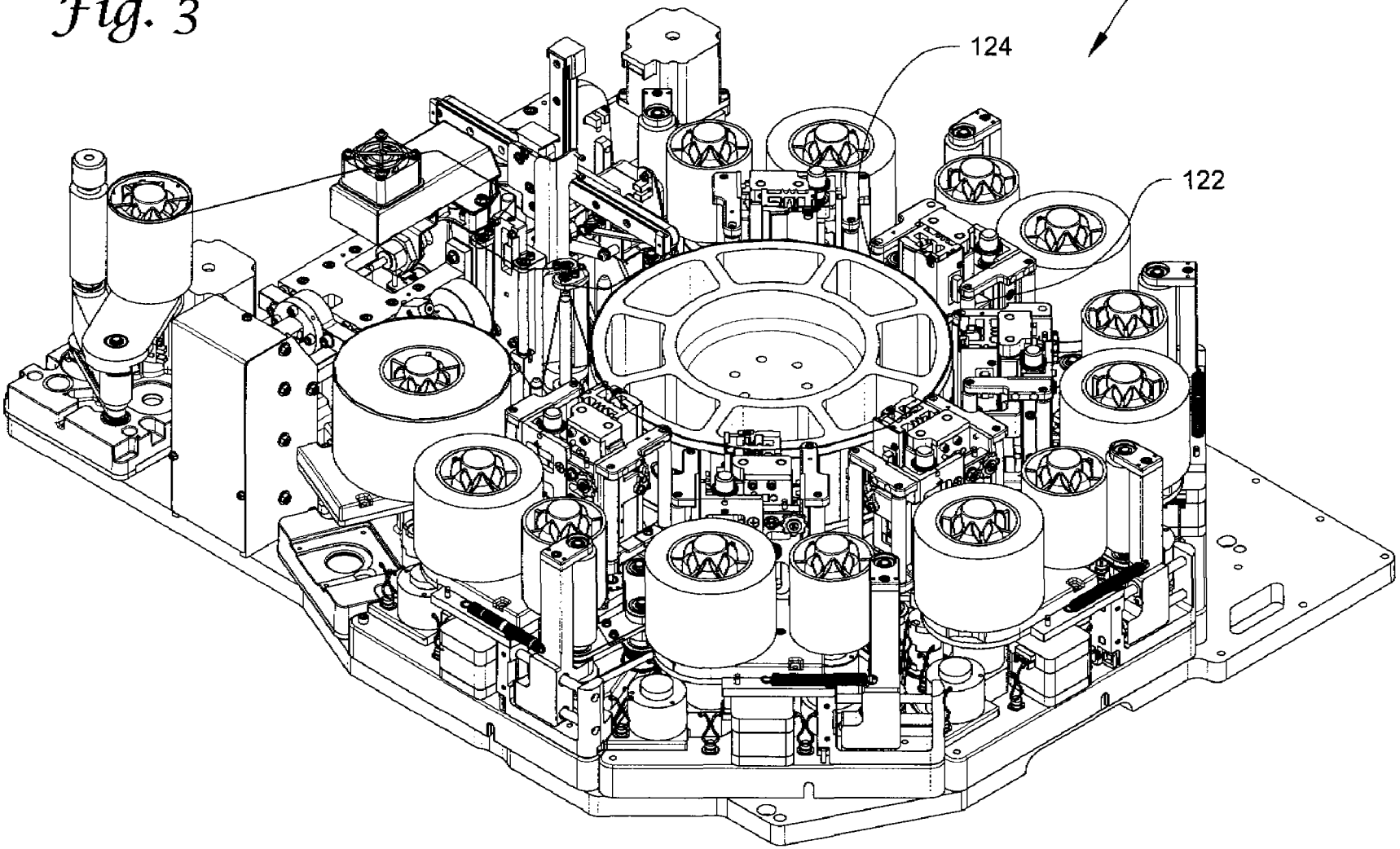
FIG. 3 represents an isometric view of the system of FIG. 2.

FIGS. 11 through 14 illustrate various embodiments of a tension adjustment mechanism 180, such as for a system 100 shown in FIG. 2. Applicator temperature, pressure, card thickness and component wear can affect the linear velocity of a card while it is being processed, such as in the applicator component 160. A change in linear velocity can result in a change of web tension. Excessive web tension can cause image distortion, wrinkles and poor image geometry. Minimal web tension can cause poor image to card registration and web material wrinkles.

The tension adjustment mechanism 180 described is used to maintain constant velocity and uniform tension of the web material within and between the components of the system 100. It will be appreciated that the tension adjustment mechanism may be used in any application where uniform tension and/or tension adjustments are required in a web material.

Generally, the tension adjustment mechanism 180 includes a support body 182. A displacement arm 184 is mounted on the support body 182 and is rotatable with respect to the support body 182. The displacement arm 184 is receivable for a web material through a slot 185, such as web material 190. In one embodiment, the web material is receivable through the displacement arm at an initial tension. In another embodiment, a guide 188 may be employed to further support the web material and facilitate its travel through the tension adjustment mechanism 180. (See also FIG. 2.) The displacement arm 184 can rotate in a first direction when an increased tension is applied from one side, and can rotate in a second direction when a decreased tension is applied from another side.

A detector component 186 is mounted on the support body 182, and is operatively connected with the displacement arm 184. The detector component 186 can detect a transition indicated by the increased or decreased tension on the displacement arm 184, through rotational movement of the displacement arm 184. The transition detected by the detector component 186 is readable by a controller (i.e. controller 11) for making tension and velocity adjustments on the web material 190.

The detector component 186 may be a suitable encoder structure that records transitions indicated by the displacement arm 184. The encoder is configured so as to indicate and quantify directional and distance changes of the displacement arm 184. The displacement arm 184 may be a spring loaded tension displacement arm that is operatively connected with the encoder. In an exemplary embodiment, the web material 190 is routed through the displacement arm 184 and guide 188 in such a manner that when speed changes occur either upstream or downstream, the displacement arm 184 rotates. Rotation of the arm 184 results in transitions being recorded on the detector component 186. The detector component 186 can then be linearized by a controller, and upstream or downstream mechanics can be adjusted to maintain uniform tension and velocity of the web material 190.

In one embodiment, tension is adjusted by varying the speed at the take-up side of the system, such as at the take-up motor. By using the encoder to determine the rotational position of the tension mechanism 180, the take-up motor speed can be adjusted to maintain the tension mechanism within a certain range of acceptable motion. In one example, the tension mechanism may be designed (but is not necessary) such that linearity is assumed, where in a linear system the speed of the take-up motor would increase or decrease a fixed amount based on the difference in encoder positions taken between two fixed time samples. It will be appreciated, however, that a non-linear controller algorithm could be implemented that increases/decreases the take-up motor by a variable value based on the amount of tension change between fixed time samples.

As described with the other components, a controller (i.e. controller 11) maintains throughput of the web material 190 through the system 100. The controller synchronizes operation cycles of the components 120, 140, and 160, such that the components have simultaneous processing cycles and have simultaneous intervals between processing cycles. The controller may be a CPU that controls the components through suitably constructed firmware configurations. Likewise, the controller can be operatively connected with the tension adjustment mechanism 180 and detector component 186 to perform the necessary tension adjustment functions discussed above.

In operation, the tension adjustment mechanism 180 compensates for tension differences as well as web stretching that occur due to heat and tension, such as during the application cycle. Variance in web motion between the time the image registration mark has been read and the time the card and web material meet, results in a visible error applying the image to the card. Web variance can be caused by several factors including, but not limited to, slippage on the web take-up capstan rollers, a change in speed of the print drum, heated apply rollers of the applicator component, or the web material itself. Such changes in the web material motion can occur often, such as when the card and web are inserted into the applicator component, and particularly at a nip between the applicator heated rollers.

Further, the act of heating the web material combined with the tension of pulling the web through the applicator heated rollers can cause the web to stretch. Such stretching may occur as high as about 0.100 inches over 4 inches of web length. This stretching causes error in the web registration unless compensation is made for tension changes.

Figure 15:
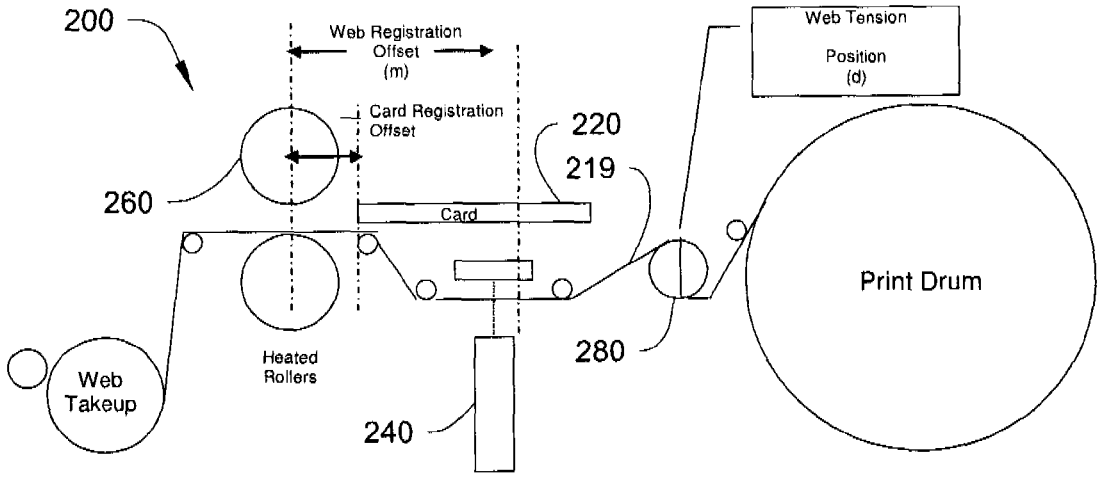
FIG. 15 represents a schematic view of a tensioning mechanism in operation, and shows the tensioning mechanism in a state of initial tension.
Figure 16:
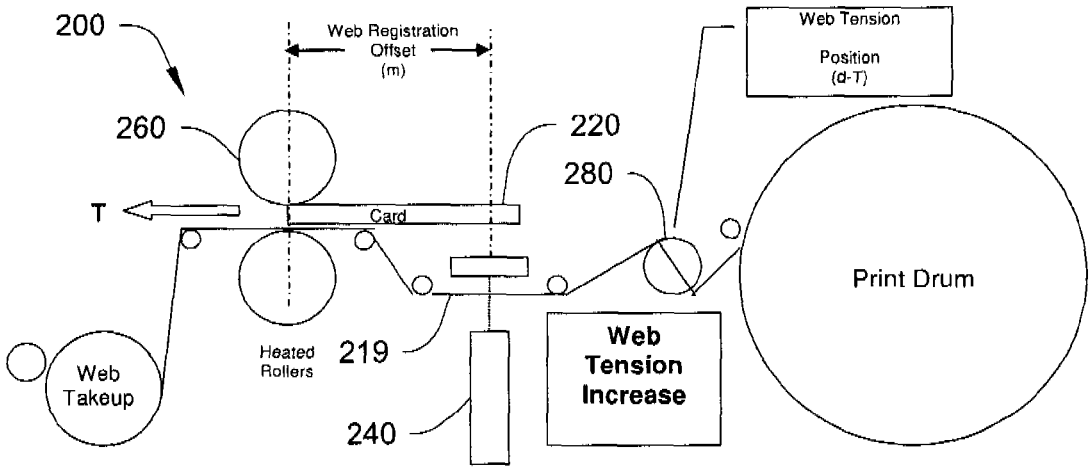
FIG. 16 represents a schematic view of a tensioning mechanism in operation, and shows the tensioning mechanism in a state of increased tension.
Figure 17:
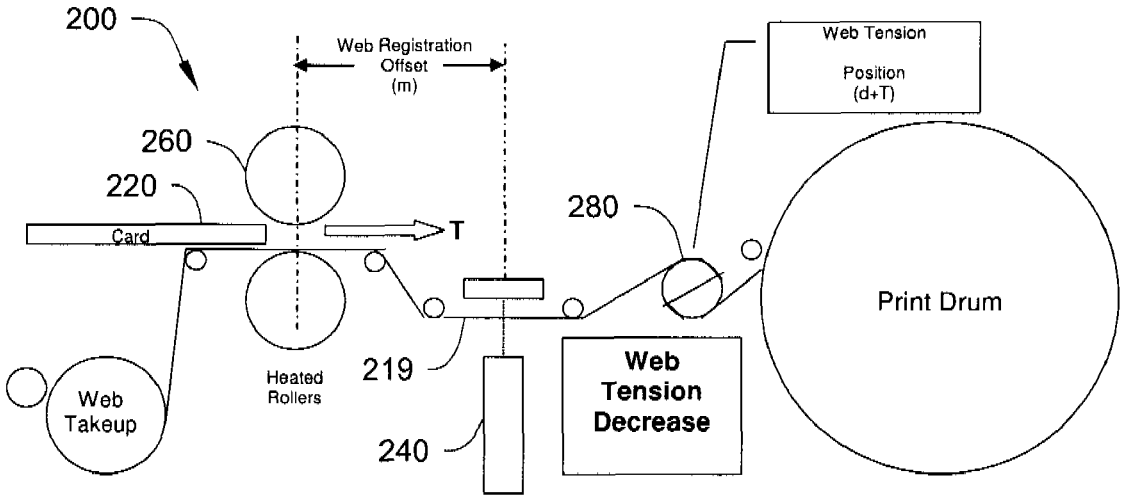
FIG. 17 represents a schematic view of a tensioning mechanism in operation, and shows the tensioning mechanism in a state of decreased tension.
Figure 18:
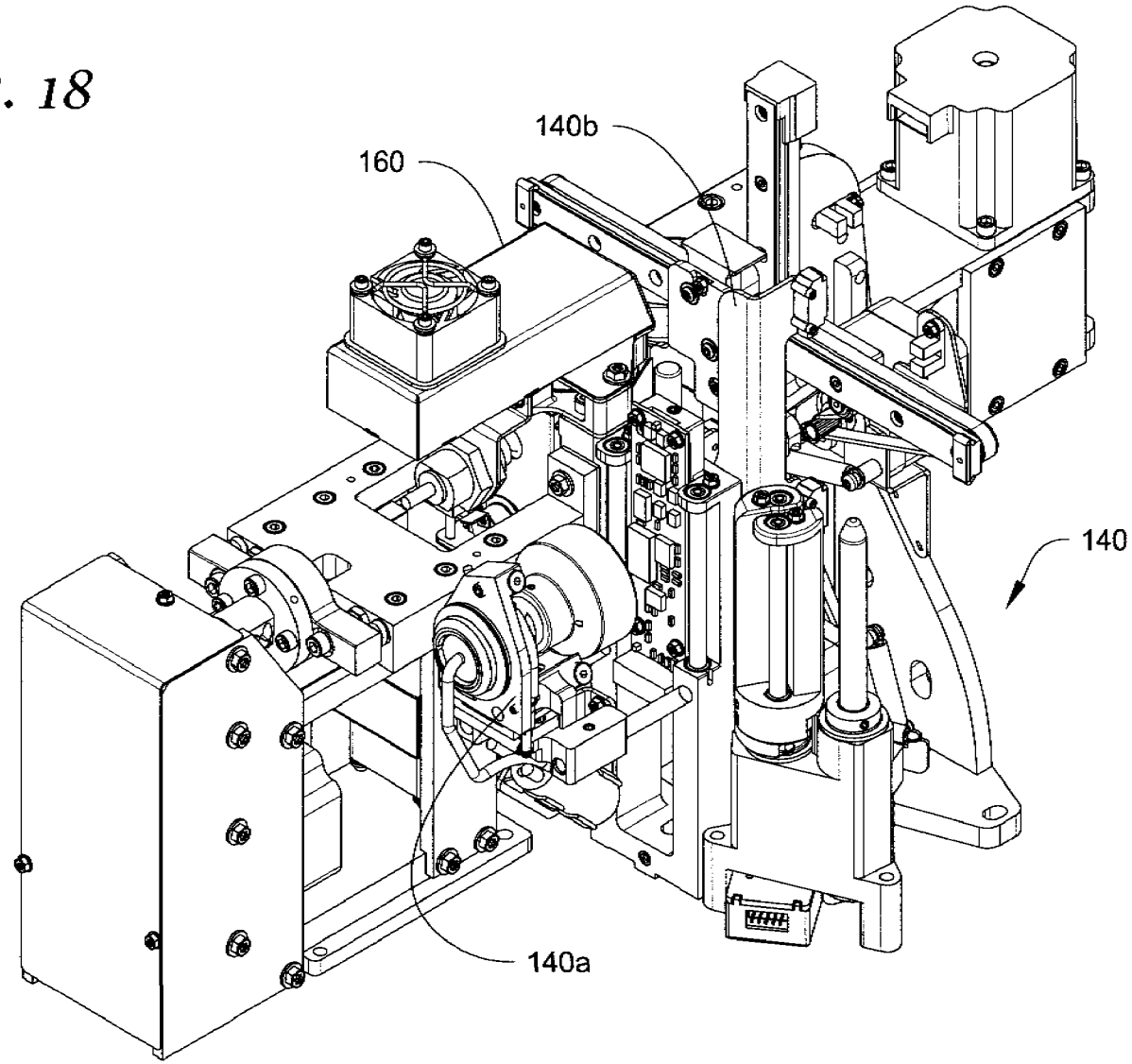
FIG. 18 represents a partial isometric view of the system shown in FIG. 2, and shows an embodiment of a registration component and applicator component.
Figure 19:
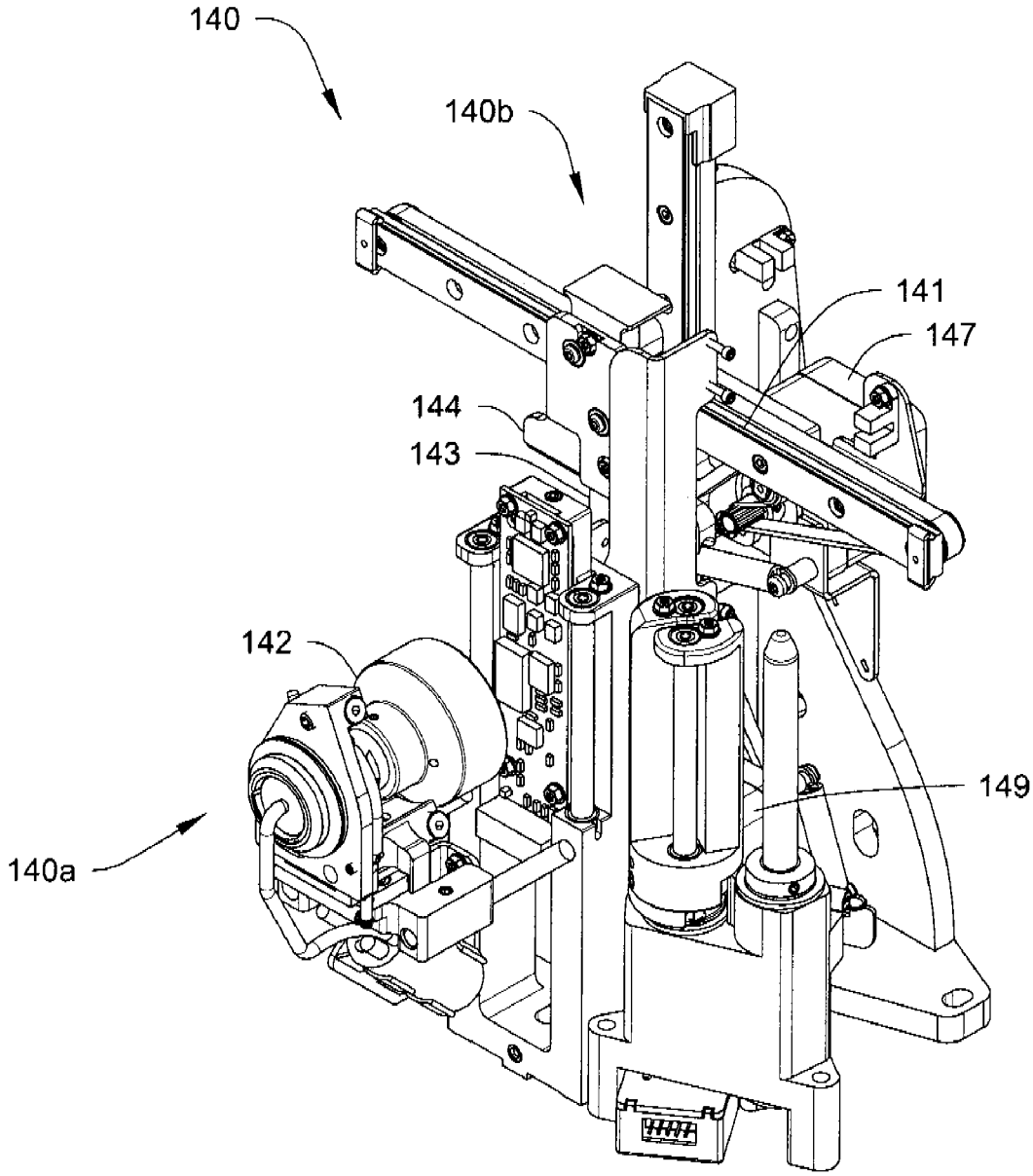
FIG. 19 represents an isometric view of the registration component shown in FIG. 18.
Figure 20:
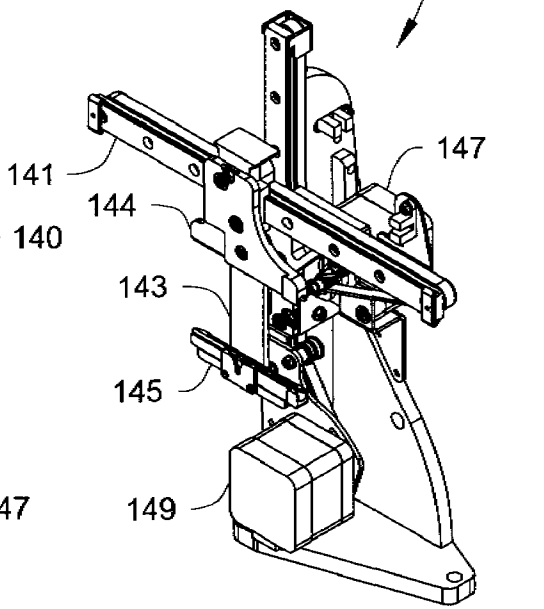
FIG. 20 represents another isometric view of the registration component shown in FIG. 18.
Figure 21:
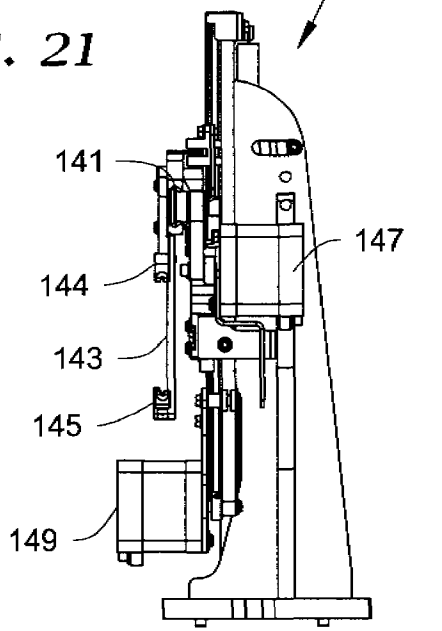
FIG. 21 represents a side view of the registration component shown in FIG. 18.
Figure 23:
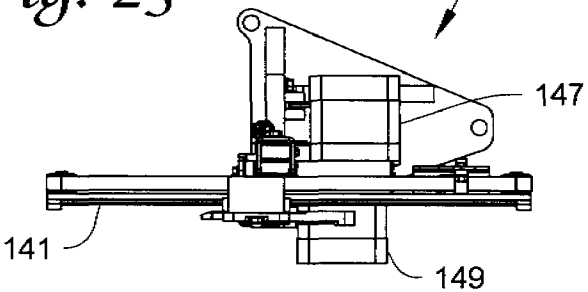
FIG. 23 represents a top view of the registration component shown in FIG. 18.
Figure 22:
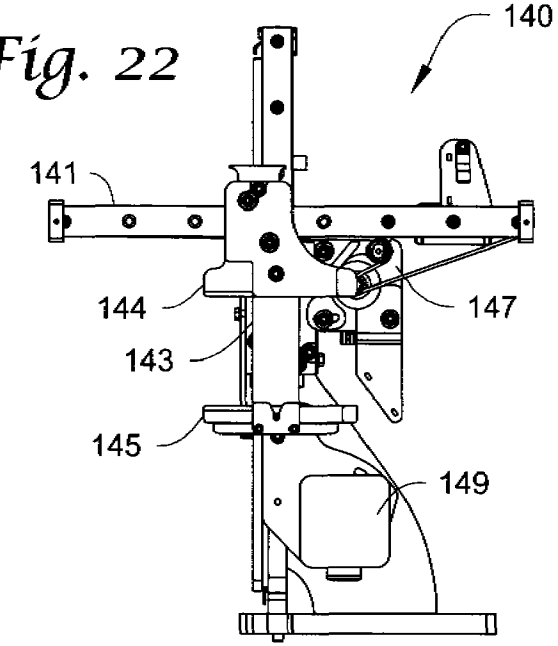
FIG. 22 represents another side view of the registration component shown in FIG. 18.

Turning to FIGS. 15 through 17, one embodiment of a system 200 shows a tension adjustment mechanism 280 in operation. Once an image registration mark of an image (i.e. registration mark 192*a* of an image 192) has been detected by the web registration mechanism 240, the leading edge of the image on the web material 219 can be advanced to meet the document or card 220 it is to be applied at the nip of the heated rollers of the applicator component 260. In one embodiment, it is desired to have the card 220 and image arrive at the same point (i.e. nip of heated rollers) at the same time to avoid a visible image registration error from occurring.

The web material move between a position at the web registration mechanism 240 of the registration component and a position of the heated roller nip of the applicator component 260 is a configurable offset measured in web take-up mechanism motor steps. That is, the web take-up mechanism motor steps or web registration offset (m) represents a configurable distance between the web registration mechanism 240 and the heated roller nip of the applicator component 260.

In this exemplary embodiment of operation, the distance between the heated roller of the applicator component and the web material is fixed, and is determined by the mechanical tolerances of the mechanism. This distance is represented by a configurable parameter to describe the distance between the leading edge of the image on the web material once the image has been registered (i.e. using the registration bar code). The distance between the registration mechanism and the heated roller nip of the applicator component is also a configurable parameter. These values are used to determine, for example, when the print component is to signal placement of the card in the heated roller nip of the applicator component. The speed on the take-up side can be used in this calculation in order to determine the amount of time required to move the configured distance to the heated roller nip of the applicator component. It will be appreciated that the range of desirable web tension encoder values can be determined on every power cycle. In this configuration, the tension mechanism can be placed in both extreme positions, and the corresponding encoder values read and stored. The "ideal" operating encoder range can then be determined by these values.

As in FIGS. 15-17, as the image on the web material 219 is registered, the web registration offset (m) is adjusted when the web tension changes. When a web registration bar of an image is read during registration, a control firmware records a position (d) of the tension adjustment mechanism (i.e. displacement arm), and begins the web registration offset adjustment process. In one embodiment, prior to every web take-up motor step during a registration process, the control firmware adjusts the web registration offset (m) by adding additional motor step counts, or subtracting motor step counts based on the relative motion of the tension adjustment mechanism 280 (i.e. displacement arm).

If the web tension increases, as shown in FIG. 16, such as where the rotational position of the tension adjustment mechanism 280 is (d-T), then the web take-up speed will have exceeded the print drum speed of the print component. The web registration offset (m) is decreased according to the amount of tension increase as indicated by the detector component of the web tension mechanism (i.e. detector component 186). If the web tension decreases, as shown in FIG. 17, where the position of the displacement arm 184 is (d+T), then the web take-up speed will have dropped below the print drum speed. In this case, the web registration motor offset (m) is increased accordingly as indicated by the detector component of the web tension mechanism. This adjustment process continues until the web registration offset step count has been exhausted. In this configuration, the web registration offset step count, which is used to determine when the web material is in position in front of the heated rollers, is decremented or adjusted to zero. Once exhausted, a card registration mechanism of the registration component can feed the card into the applicator component 260 at the nip of the heated rollers at the same speed as the web, so that the application process can begin.

The tension adjustment mechanism 280 provides an assembly that is compact and suitable for use in web material handling and to measure relatively small displacements. In this manner, the mechanism 280 helps address issues of variance in web tension and velocity. The tension adjustment mechanism 280 described can allow for greater tolerance variations, such as may be caused by variations in drum and applicator roller diameters. The tension adjustment mechanism can also compensate for variations in card stock thickness, applicator pressure and temperatures.

Registration Component

FIGS. 18 through 23 illustrate one embodiment of a registration component 140, such as for the system 100 shown in FIG. 2. Where multiple images and cards are being processed, the registration component 140 can provide a high speed precise horizontal and vertical card transport and registration device.

Generally, the registration component 140 includes a web registration mechanism 140*a* and a card registration mechanism 140*b*. As one exemplary embodiment, the web registration mechanism 140*a* may be a laser mechanism 142 that reads the image registration mark of an image to help initiate registration of an image to a card. As shown in FIGS. 2-6, web registration mechanism 140*a* is disposed between the tension adjustment mechanism 180 and the applicator component 160.

The card registration mechanism 140*b* may be a gantry structure that can manipulate a card in x-y directions. The card registration mechanism 140*b* transfers and registers the card with the web material 190 before entry into the applicator component 160. By a gantry support, the card registration mechanism 140*b* may be any suitable frame structure raised on side supports so as to span over or around the card. Such a gantry card transport contains upper and lower card guides for moving the card in the x-y directions. The upper and lower card guides 144, 145 are respectively powered by horizontal and vertical motors 147, 149. The lower card guide 145 provides a bias against a card to provide friction and card alignment. In one embodiment, the lower card guide 145 is spring loaded. In such a configuration the lower card guide 145 can help keep the card in place in the gantry while it is being moved in x and/or y directions. The gantry can move on horizontal and vertical rails 141, 143 while registering the card to the image on the web material.

In operation, the laser mechanism 142 examines the web looking for the next registration mark. On detection of the web registration mark, the gantry registers the card with a respective image and feeds the card into the applicator component 160 at its heated roller nip to initiate application processing.

As described, a controller (i.e. controller 11) is operatively connected with the registration component 140. The controller maintains throughput of the web material 190 through the system 100 to continuously print and apply images to documents. The controller synchronizes operation cycles of the components, such that they have simultaneous processing cycles and have simultaneous intervals between processing cycles. The controller may be a CPU that controls the components through suitably constructed firmware configurations. Likewise, a controller is used to operate the registration component 140.

For the card registration mechanism 140*b* in system 100, a control firmware for operation includes standard x/y robotic controls. Such controls may also be used to transport a card across the upper portion of the system 100 in order to pass a card through the system 100 without applying an image to the card. Typically, the card registration mechanism 140*b* receives a card from a conveyor mechanism (not shown), and positions the card with speed and accuracy to a designated registration position. However, if a particular card is not desired for image application, the card may be made to bypass registration and application. It will be appreciated that a conveyor mechanism is known in the art to deliver documents or cards in within processing modules, and is not further described.

Once in the registration position, the web material can be scanned until a selected image for a specified card has been located. Once located, the control firmware evaluates a time and distance required to move the card into the nip of the heated rollers of the applicator component, as well as a time and distance required to move a leading edge of the image on the web to the nip of the heated rollers. The horizontal or "x" motor 147 may then be started at the appropriate time to ensure the card and the leading edge of the image meet at the heated roller nip at the same time, and at the same speed.

In addition, upon detection of the selected image on the web material, the vertical or "y" motor 149 can adjust the card to match the location of the registration mark read on the image of the web material. In this manner, the card registration mechanism 140*b* can adjust for rising or falling of the web in the y-axis with respect to the web registration mark read by the web registration mechanism 140*a*.

The registration component 140, and namely the card registration mechanism 140*b*, enables a card to be presented to the applicator component 160 other than by drive rollers. Because the card registration mechanism 140*a* contains no rollers, it can be formed as a lightweight assembly that can be moved at high speeds and accelerations, while maintaining accuracy and precision in the horizontal and vertical directions.

With regard to the foregoing description, it is to be understood that changes may be made in detail, especially in matters of the construction materials employed and the shape, size, and arrangement of the parts without departing from the scope of the present invention. It is intended that the specification and depicted embodiments be considered exemplary only, and that the true scope and spirit of the invention being indicated by the broad meaning of the following claims.

We claim:

1. A system for printing images and transferring the images to identity documents comprising:

a web material having a surface for printing images thereon;

a print component configured to print images on the web material;

a registration component configured to register select images printed on the web material with identity documents;

an applicator component configured to apply each selected image to one of the identity documents, after the image is registered with the identity document; and a controller configured to control the print component, registration component, and applicator component, so that the system continuously prints images and continuously applies images to identity documents, the controller configured to synchronize cycles of the print component, registration component, and applicator component, such that the components have simultaneous processing cycles and have simultaneous intervals between processing cycles, wherein the controller configured to stop the print component from printing on the web material in the presence of an error, reverse the web material to a gap on the web material between images, and continue printing on the web material once the error has been corrected.

2. The system according to claim 1, wherein, when an error is present, the controller configured to retrieve and store a position of the print component, and configured to determine a total distance that the print component and web material need to be reversed past the position in order to restart the print component.

3. The system according to claim 2, wherein the total distance comprises:

a distance determined by a number of print drum motor steps required to accelerate a print drum motor, and a distance between printed images on the web material.

4. The system according to claim 2, wherein the total distance comprises:

a distance determined by a number of motor steps required to position print heads of the print component; and a distance determined by a number of motor steps required to accelerate print ribbons of the print component.

5. The system according to claim 1, wherein the registration component comprises a web registration mechanism and a document registration mechanism.

6. The system according to claim 5, wherein the web registration mechanism and the document registration mechanism configured to position each selected image with a respective identity document, such that the image and identity document configured to simultaneously enter the applicator component.

7. The system according to claim 5, wherein the web registration mechanism comprises a laser mechanism configured to read image registration marks of the images printed on the web material, and the controller configured to determine whether to select and register the image with an identity document, based on a reading of the laser mechanism.

8. The system according to claim 5, wherein the document registration mechanism comprises upper and lower card guides that are respectively movable in x-y directions and configured to move the identity document in the x-y directions and register the respective identity document with the respective selected image.

9. The system according to claim 1, further comprising a tension adjustment mechanism, the tension adjustment mechanism configured to maintain constant velocity and uniform tension of the web material within and between components of the system.

10. The system according to claim 9, wherein the tension adjustment mechanism comprises a displacement arm rotatably mounted on a support body, the displacement arm receivable of the web material and supports the web material thereon, and the displacement arm rotatable in a first direction in the presence of an increased tension on the displacement arm and is rotatable in a second direction in the presence of an decreased tension applied on the displacement arm.

11. The system according to claim 9, wherein the tension adjustment mechanism comprises a detector component, the detector component configured to detect a transition of the displacement arm in the presence of an increase or decrease in tension on the displacement arm, which is indicated by rotational movement of the displacement arm, the transition detected by the detector component readable by the controller so that velocity and tension adjustments can be made on the web material.

12. The system according to claim 11, wherein the controller configured to adjust a web registration offset by adding or subtracting motor steps to control throughput of the web material, based on the transition read by the controller.

13. The system according to claim 1, wherein the images printed on the web material comprises:

an image for applying to the identity document and a registration mark read by the registration component.

14. The system according to claim 1, further comprising a component spacing between each of the print component, registration component, and applicator component, where in the presence of an error during processing, an identity document being processed by the applicator component is not rejected and images printed on the web material are saved.

15. The system according to claim 14, wherein the component spacing comprises a predetermined length or a multiple thereof, where the print component, registration component, and applicator component include the component spacing therebetween, and which corresponds to the predetermined length or a multiple of the predetermined length.

16. The system according to claim 15, wherein the predetermined length corresponds to an image to image length on the web material.

17. A method for continuously printing images on a web material and transferring the images on the web material to identity documents comprising:

printing images on the web material with a print component;

registering select images on the web material with identity documents with a registration component;

applying each selected image to one of the identity documents with an applicator component, after the image is registered with the respective identity document; and continuously performing the printing, registering, and applying steps for a plurality of selected images and a plurality of identity documents, with a controller configured to control the print component, registration component, and applicator component, such that cycles of the printing, registering, and applying steps are synchronized having simultaneous processing cycles and having simultaneous intervals between processing cycles, detecting an error such that, when an error is detected, stopping the processing cycles of the printing, registering, and applying steps and correcting the detected error during an interval between processing cycles of the printing, registration, and applying step.

18. The method according to claim 17, wherein the registering step comprises reading the images on the web material to determine the select images;

positioning the identity documents in x-y directions, such that each select image is registered with one identity document.

* * * * *